US006887068B2

(12) United States Patent
Spicer

(10) Patent No.: US 6,887,068 B2
(45) Date of Patent: May 3, 2005

(54) CENTERING PLATE FOR BURNER

(75) Inventor: David B. Spicer, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

(21) Appl. No.: 10/389,549

(22) Filed: Mar. 14, 2003

(65) Prior Publication Data

US 2003/0175644 A1 Sep. 18, 2003

Related U.S. Application Data

(60) Provisional application No. 60/365,151, filed on Mar. 16, 2002.

(51) Int. Cl.[7] ..... F23M 3/00
(52) U.S. Cl. ..... 431/9; 431/115
(58) Field of Search ..... 431/9, 115, 5, 431/215; 126/91 A

(56) References Cited

U.S. PATENT DOCUMENTS

| | | | |
|---|---|---|---|
| 2,368,370 | A | 1/1945 | Maxon |
| 2,813,578 | A | 11/1957 | Ferguson |
| 2,918,117 | A | 12/1959 | Griffin |

(Continued)

FOREIGN PATENT DOCUMENTS

| | | |
|---|---|---|
| CA | 1169753 | 6/1984 |
| DE | 2944153 | 5/1981 |
| DE | 3232421 | 3/1984 |
| DE | 3818265 | 11/1989 |
| EP | 0099828 | 6/1988 |
| EP | 0 347 956 | 12/1989 |
| EP | 0 374 423 | 6/1990 |
| EP | 0 408 171 A1 | 1/1991 |
| EP | 0 507 233 | 10/1992 |
| EP | 0 620 402 A1 | 10/1994 |
| EP | 0 674 135 B2 | 9/1995 |
| EP | 0 751 343 | 1/1997 |
| EP | 0486169 | 1/1998 |
| EP | 1096202 | 2/2001 |
| EP | 1 211 458 | 6/2002 |
| FR | 2629900 | 10/1988 |
| SU | 374488 | 3/1973 |

OTHER PUBLICATIONS

Abstract of EP 0 507 233 published on Oct. 7, 1992, entitled "Burner for Liquid Fuels".

Chemical Engineering Progress, vol. 43, 1947, "The Design of Jet Pumps" by A. Edgar Kroll, pp. 21–24, vol. 1, No. 2.

Straitz III, John F., et al., "Combat $No_x$ With Better Burner Design," *Chemical Engineering*, Nov. 1994, pp. EE–4–EE–8.

Vahdati, M. M., et al., "Design And Development of A Low $NO_x$ Coanda Ejector Burner," *Journal of the Institute of Energy*, Mar. 2000, vol. 73, pp. 12–17.

(Continued)

*Primary Examiner*—Alfred Basichas
(74) *Attorney, Agent, or Firm*—Lucinda Lomas; Linda A. Kubena

(57) ABSTRACT

A burner for use in furnaces such as in steam cracking. The burner includes a burner tube having a downstream end and an upstream end. A burner tip is mounted on the burner tube adjacent a first opening in the furnace, so that combustion of the fuel takes place downstream of the burner tip. A fuel orifice located adjacent the upstream end of the burner tube is included for introducing fuel into the burner tube. The burner may also include at least one passageway for supplying flue gas from the furnace into a primary air chamber. The burner also has a structure responsive to an inspirating effect created by uncombusted fuel exiting the fuel orifice for drawing flue gas from the furnace through the passageway and the primary air chamber. The burner also includes a plate for centering the fuel orifice with the burner tube, the centering plate being perforated to permit flow therethrough.

37 Claims, 6 Drawing Sheets

U.S. PATENT DOCUMENTS

| | | | | |
|---|---|---|---|---|
| 2,983,312 | A | | 5/1961 | Finley et al. |
| 3,880,570 | A | | 4/1975 | Marshall |
| 4,004,875 | A | | 1/1977 | Zink et al. |
| 4,089,629 | A | | 5/1978 | Baumgartner et al. |
| 4,130,388 | A | | 12/1978 | Flanagan |
| 4,230,445 | A | | 10/1980 | Janssen |
| 4,257,763 | A | | 3/1981 | Reed |
| 4,575,332 | A | | 3/1986 | Oppenberg et al. |
| 4,629,413 | A | | 12/1986 | Michelson et al. |
| 4,708,638 | A | | 11/1987 | Brazier et al. |
| 4,739,713 | A | | 4/1988 | Vier et al. |
| 4,748,919 | A | | 6/1988 | Campobenedetto et al. |
| 4,815,966 | A | | 3/1989 | Janssen |
| 4,828,483 | A | | 5/1989 | Finke |
| 4,963,089 | A | | 10/1990 | Spielman |
| 4,995,807 | A | | 2/1991 | Rampley et al. |
| 5,044,931 | A | | 9/1991 | Van Eerden et al. |
| 5,073,105 | A | | 12/1991 | Martin et al. |
| 5,092,761 | A | | 3/1992 | Dinocolantonio |
| 5,098,282 | A | | 3/1992 | Schwartz et al. |
| 5,135,387 | A | | 8/1992 | Martin et al. |
| 5,152,463 | A | | 10/1992 | Mao et al. |
| 5,154,596 | A | | 10/1992 | Schwartz et al. |
| 5,195,884 | A | | 3/1993 | Schwartz et al. |
| 5,201,650 | A | | 4/1993 | Johnson |
| 5,224,851 | A | | 7/1993 | Johnson |
| 5,238,395 | A | | 8/1993 | Schwartz et al. |
| 5,254,325 | A | * | 10/1993 | Yamasaki et al. ..... 423/450 |
| 5,263,849 | A | | 11/1993 | Irwin et al. |
| 5,269,679 | A | | 12/1993 | Syska et al. |
| 5,275,554 | A | | 1/1994 | Faulkner |
| 5,284,438 | A | | 2/1994 | McGill et al. |
| 5,299,930 | A | | 4/1994 | Weidman |
| 5,316,469 | A | | 5/1994 | Martin et al. |
| 5,326,254 | A | | 7/1994 | Munk |
| 5,344,307 | A | | 9/1994 | Schwartz et al. |
| 5,350,293 | A | | 9/1994 | Khinkis et al. |
| 5,370,526 | A | * | 12/1994 | Buschulte et al. ..... 431/116 |
| 5,407,345 | A | | 4/1995 | Robertson et al. |
| 5,413,477 | A | | 5/1995 | Moreland |
| 5,470,224 | A | | 11/1995 | Bortz |
| 5,472,341 | A | | 12/1995 | Meeks |
| 5,542,839 | A | | 8/1996 | Kelly |
| 5,562,438 | A | | 10/1996 | Gordon et al. |
| 5,584,684 | A | | 12/1996 | Dobbeling et al. |
| 5,603,906 | A | | 2/1997 | Lang et al. |
| 5,611,682 | A | | 3/1997 | Slavejkov et al. |
| 5,624,253 | A | | 4/1997 | Sulzhik et al. |
| 5,685,707 | A | | 11/1997 | Ramsdell et al. |
| 5,688,115 | A | * | 11/1997 | Johnson ..... 431/9 |
| 5,807,094 | A | | 9/1998 | Sarv |
| 5,813,846 | A | * | 9/1998 | Newby et al. ..... 431/9 |
| 5,980,243 | A | | 11/1999 | Surbey et al. |
| 5,984,665 | A | | 11/1999 | Loftus et al. |
| 5,987,875 | A | | 11/1999 | Hilburn et al. |
| 5,993,193 | A | | 11/1999 | Loftus et al. |
| 6,007,325 | A | | 12/1999 | Loftus et al. |
| 6,056,538 | A | | 5/2000 | Büchner et al. |
| 6,332,408 | B2 | | 12/2001 | Howlett et al. |
| 6,347,935 | B1 | | 2/2002 | Schindler et al. |
| 6,383,462 | B1 | | 5/2002 | Lang |
| 6,616,442 | B2 | | 9/2003 | Venizelos et al. |

OTHER PUBLICATIONS

Bussman, Wes, et al., "Low $NO_x$ Burner Technology for Ethylene Cracking Furnaces," presented at the *2001 AIChE Spring National Meeting*, 13th *Annual Ethylene Producers Conference*, Houston, TX, Apr. 25, 2001, pp. 1–23.

Seebold, James G., "Reduce Heater $NO_x$ in the Burner," *Hydrocarbon Processing*, Nov. 1982, pp. 183–186.

"West Germany's Caloric Develops a Low–$NO_x$ Recycling Fuel Burner," *Chemical Engineering*, Oct. 4, 1982, p. 17.

* cited by examiner

CENTERING PLATE FOR BURNER

RELATED APPLICATION

This patent application claims priority from Provisional Application Ser. No. 60/365,151, filed on Mar. 16, 2002, the contents of which are hereby incorporated by reference.

FIELD OF THE INVENTION

This invention relates to an improvement in a burner such as those employed in high temperature industrial furnaces in the steam cracking of hydrocarbons. More particularly, it relates to the use of a fuel riser centering plate designed for reducing flow losses in the region of the burner inlet.

BACKGROUND OF THE INVENTION

As a result of the interest in recent years to reduce the emission of pollutants from burners used in large industrial furnaces, burner design has undergone substantial change. In the past, improvements in burner design were aimed primarily at improving heat distribution. Increasingly stringent environmental regulations have shifted the focus of burner design to the minimization of regulated pollutants.

Oxides of nitrogen ($NO_x$) are formed in air at high temperatures. These compounds include, but are not limited to nitrogen oxide and nitrogen dioxide. Reduction of $NO_x$ emissions is a desired goal to decrease air pollution and meet government regulations. In recent years, a wide variety of mobile and stationary sources of $NO_x$ emissions have come under increased scrutiny and regulation.

One strategy for achieving lower $NO_x$ emission levels is to install a $NO_x$ reduction catalyst to treat the furnace exhaust stream. This strategy, known as Selective Catalytic Reduction (SCR), is very costly and, although it can be effective in meeting more stringent regulations, represents a less desirable alternative to improvements in burner design.

Burners used in large industrial furnaces may use either liquid fuel or gas. Liquid fuel burners mix the fuel with steam prior to combustion to atomize the fuel to enable more complete combustion, and combustion air is mixed with the fuel at the zone of combustion.

Gas fired burners can be classified as either premix or raw gas, depending on the method used to combine the air and fuel. They also differ in configuration and the type of burner tip used.

Raw gas burners inject fuel directly into the air stream, and the mixing of fuel and air occurs simultaneously with combustion. Since airflow does not change appreciably with fuel flow, the air register settings of natural draft burners must be changed after firing rate changes. Therefore, frequent adjustment may be necessary, as explained in detail in U.S. Pat. No. 4,257,763, which patent is incorporated herein by reference. In addition, many raw gas burners produce luminous flames.

Premix burners mix the fuel with some or all of the combustion air prior to combustion. Since premixing is accomplished by using the energy present in the fuel stream, airflow is largely proportional to fuel flow. As a result, therefore, less frequent adjustment is required. Premixing the fuel and air also facilitates the achievement of the desired flame characteristics. Due to these properties, premix burners are often compatible with various steam cracking furnace configurations.

Floor-fired premix burners are used in many steam crackers and steam reformers primarily because of their ability to produce a relatively uniform heat distribution profile in the tall radiant sections of these furnaces. Flames are non-luminous, permitting tube metal temperatures to be readily monitored. Therefore, a premix burner is the burner of choice for such furnaces. Premix burners can also be designed for special heat distribution profiles or flame shapes required in other types of furnaces.

In gas fired industrial furnaces, $NO_x$ is formed by the oxidation of nitrogen drawn into the burner with the combustion air stream. The formation of $NO_x$ is widely believed to occur primarily in regions of the flame where there exist both high temperatures and an abundance of oxygen. Since ethylene furnaces are amongst the highest temperature furnaces used in the hydrocarbon processing industry, the natural tendency of burners in these furnaces is to produce high levels of $NO_x$ emissions.

One technique for reducing $NO_x$ that has become widely accepted in industry is known as staging. With staging, the primary flame zone is deficient in either air (fuel-rich) or fuel (fuel-lean). The balance of the air or fuel is injected into the burner in a secondary flame zone or elsewhere in the combustion chamber. As is well known, a fuel-rich or fuel-lean combustion zone is less conducive to $NO_x$ formation than an airfuel ratio closer to stoichiometry. Staging results in reducing peak temperatures in the primary flame zone and has been found to alter combustion speed in a way that reduces $NO_x$ . Since $NO_x$ formation is exponentially dependent on gas temperature, even small reductions in peak flame temperature dramatically reduce $NO_x$ emissions. However this must be balanced with the fact that radiant heat transfer decreases with reduced flame temperature, while carbon monoxide (CO) emissions, an indication of incomplete combustion, may actually increase as well.

In the context of premix burners, the term primary air refers to the air premixed with the fuel; secondary, and in some cases tertiary, air refers to the balance of the air required for proper combustion. In raw gas burners, primary air is the air that is more closely associated with the fuel; secondary and tertiary air is more remotely associated with the fuel. The upper limit of flammability refers to the mixture containing the maximum fuel concentration (fuel-rich) through which a flame can propagate.

Thus, one set of techniques achieves lower flame temperatures by using staged-air or staged-fuel burners to lower flame temperatures by carrying out the initial combustion at far from stoichiometric conditions (either fuel-rich or air-rich) and adding the remaining air or fuel only after the flame has radiated some heat away to the fluid being heated in the furnace.

Another set of techniques achieves lower flame temperatures by diluting the fuel-air mixture with diluent material. Flue-gas (the products of the combustion reaction) or steam are commonly used diluents. Such burners are classified as FGR (flue-gas-recirculation) or steam-injected, respectively.

Patents relating to improvements in burner design include U.S. Pat. No. 5,092,761, which discloses a method and apparatus for reducing $NO_x$ emissions from premix burners by recirculating flue gas. Flue gas is drawn from the furnace through a pipe or pipes by the inspirating effect of fuel gas and combustion air passing through a venturi portion of a burner tube. The flue gas mixes with combustion air in a primary air chamber prior to combustion to dilute the concentration of oxygen ($O_2$) in the combustion air, which lowers flame temperature and thereby reduces $NO_x$ emissions. The contents of U.S. Pat. No. 5,092,761 are incorporated herein by reference.

In certain premix burners, a centering plate is utilized to assure that the fuel riser/burner spud assembly is aligned with the venturi to ensure maximum entrainment.

Analysis of burners of the type described in U.S. Pat. No. 5,092,761 has indicated the flue-gas-recirculation (FGR) ratio is generally in the range 5–10% where FGR ratio is defined as:

$$FGR \text{ ratio } (\%)=100[G/(F+A)]$$

where G=Flue-gas drawn into venturi, (lb)
F=Fuel combusted in burner, (lb), and
A=Air drawn into burner, (lb).

The ability of these burners to generate higher FGR ratios is limited by the inspirating capacity of the gas spud/venturi combination. Further closing or partially closing the primary air dampers will produce lower pressures in the primary air chamber and thus enable increased FGR ratios. However, the flow of primary air may be reduced such that insufficient oxygen exists in the venturi for acceptable burner stability. Moreover, internal flow dynamics in the area of the fuel riser/burner spud assembly/venturi combination can affect the inspirating capacity of the combination, reducing the ability to achieve FGR rates in excess of 10%. In this regard, the fuel riser/burner spud centering plate, utilized to assure that the fuel riser/burner spud assembly is aligned with the venturi, can serve to negatively affect internal flow dynamics in the area of the fuel riser/burner spud assembly/venturi combination, reducing inspirating capacity.

Therefore, what is needed is a burner for the combustion of fuel gas and air that enables higher flue gas recirculation ratios (FGR) to be utilized, yielding further reductions in $NO_x$ emissions.

SUMMARY OF THE INVENTION

The present invention is directed to a burner capable of achieving lower levels of $NO_x$ emissions for use in furnaces such as those employed in steam cracking. The burner includes a burner tube having a downstream end and an upstream end. A burner tip is mounted on the burner tube adjacent a first opening in the furnace, so that combustion of the fuel takes place downstream of the burner tip. A fuel orifice is located adjacent the upstream end of the burner tube for introducing fuel into the burner tube. At least one passageway is provided for supplying flue gas from the furnace into a primary air chamber. The burner also has means responsive to an inspirating effect created by uncombusted fuel exiting the fuel orifice for drawing flue gas from the furnace through the passageway and the primary air chamber. The uncombusted fuel flows through the burner tube from its upstream end towards its downstream end, whereby the flue gas is mixed with air at the upstream end of the burner tube prior to the zone of combustion of the fuel and air to thereby lower the temperature of the drawn flue gas. The burner also has means including a plate for centering the fuel orifice in alignment with the burner tube, with the centering plate being perforated to permit flow therethrough from the primary air chamber. The perforated centering plate design reduces flow losses that result from a tortuous flow pattern caused by a solid centering plate.

Also provided is a method for reducing $NO_x$ emissions in a burner for the combustion of fuel, the burner being located adjacent a first opening in a furnace and including a primary air chamber, a burner tube including a downstream end and an upstream end, a burner tip adjacent the first opening in the furnace, so that combustion of the fuel takes place downstream of the burner tip and a fuel orifice located adjacent the upstream end of said burner tube, for introducing fuel into said burner tube, the fuel orifice being mounted on a riser; the method comprising installing a plate for centering the fuel orifice in alignment with said burner tube, the centering plate being perforated to permit flow therethrough from the primary air chamber.

In a specific aspect of the present invention, the centering plate has an outer ring member, an inner centering member and a plurality of radially extending spokes connecting the outer ring member and the inner centering member. Further, the outer ring member fixedly secures the centering plate within the primary air chamber; and the riser extends through the inner centering member and is supported therein. In addition, the outer ring member is connected to a surface of the primary air chamber by a plurality of support members. The perforated centering plate design smoothes out the flow vectors entering a venturi portion of the burner tube to enable higher venturi capacity. The reduced flow losses at the venturi inlet results in higher venturi capacity, higher flue gas recirculation rate, lower flame temperature and lower $NO_x$ production.

An object of the present invention is to provide a burner arrangement that permits higher flue gas recirculation rates to be employed, thus reducing $NO_x$ emissions.

These and other objects and features of the present invention will be apparent from the detailed description taken with reference to accompanying drawings.

BRIEF DESCRIPTION OF THE DRAWINGS

The invention is further explained in the description that follows with reference to the drawings illustrating, by way of non-limiting examples, various embodiments of the invention wherein.

DETAILED DESCRIPTION OF SPECIFIC EMBODIMENTS

Figure 1:
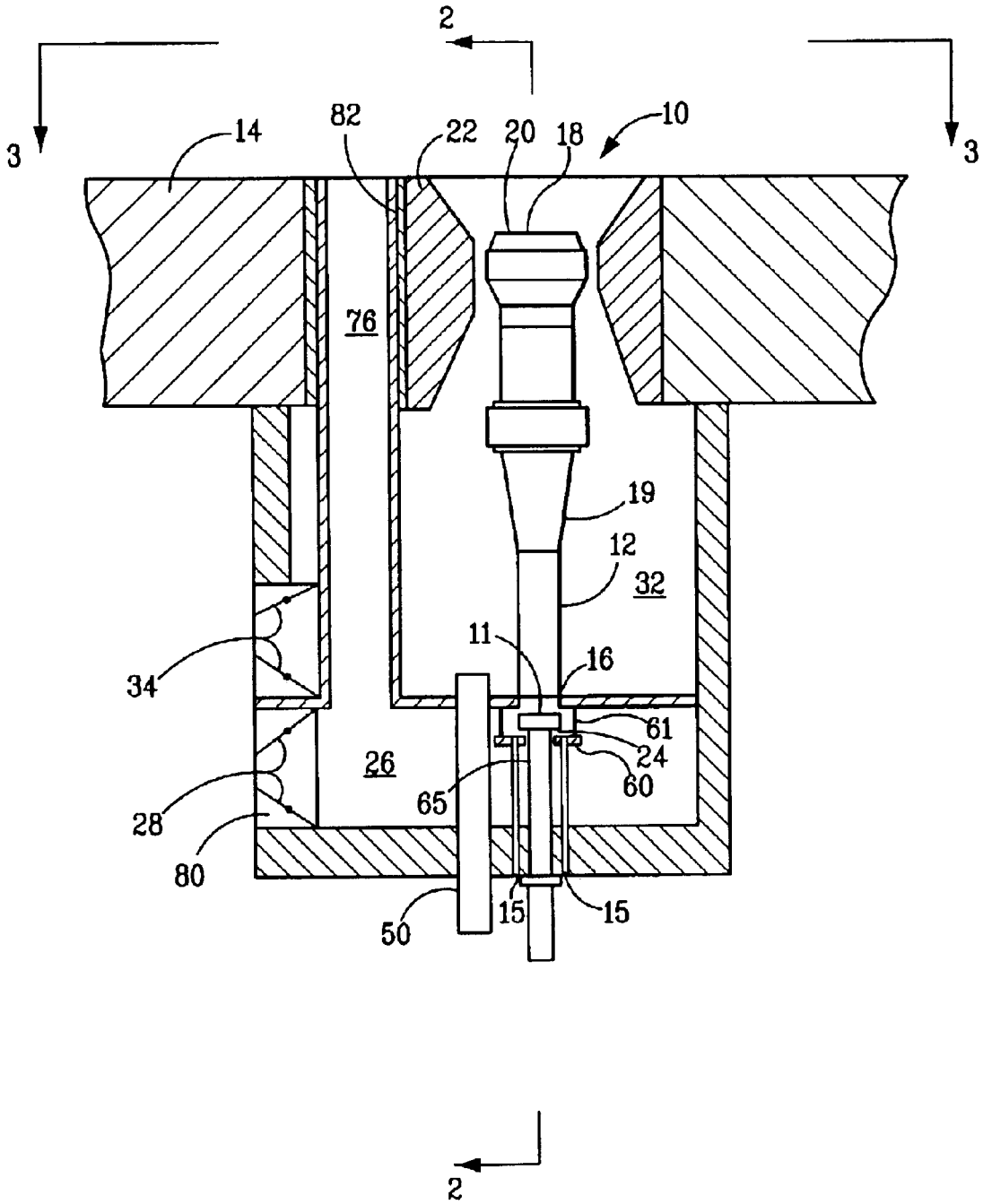
FIG. 1 illustrates an elevation partly in section of an embodiment of the burner of the present invention.
Figure 2:
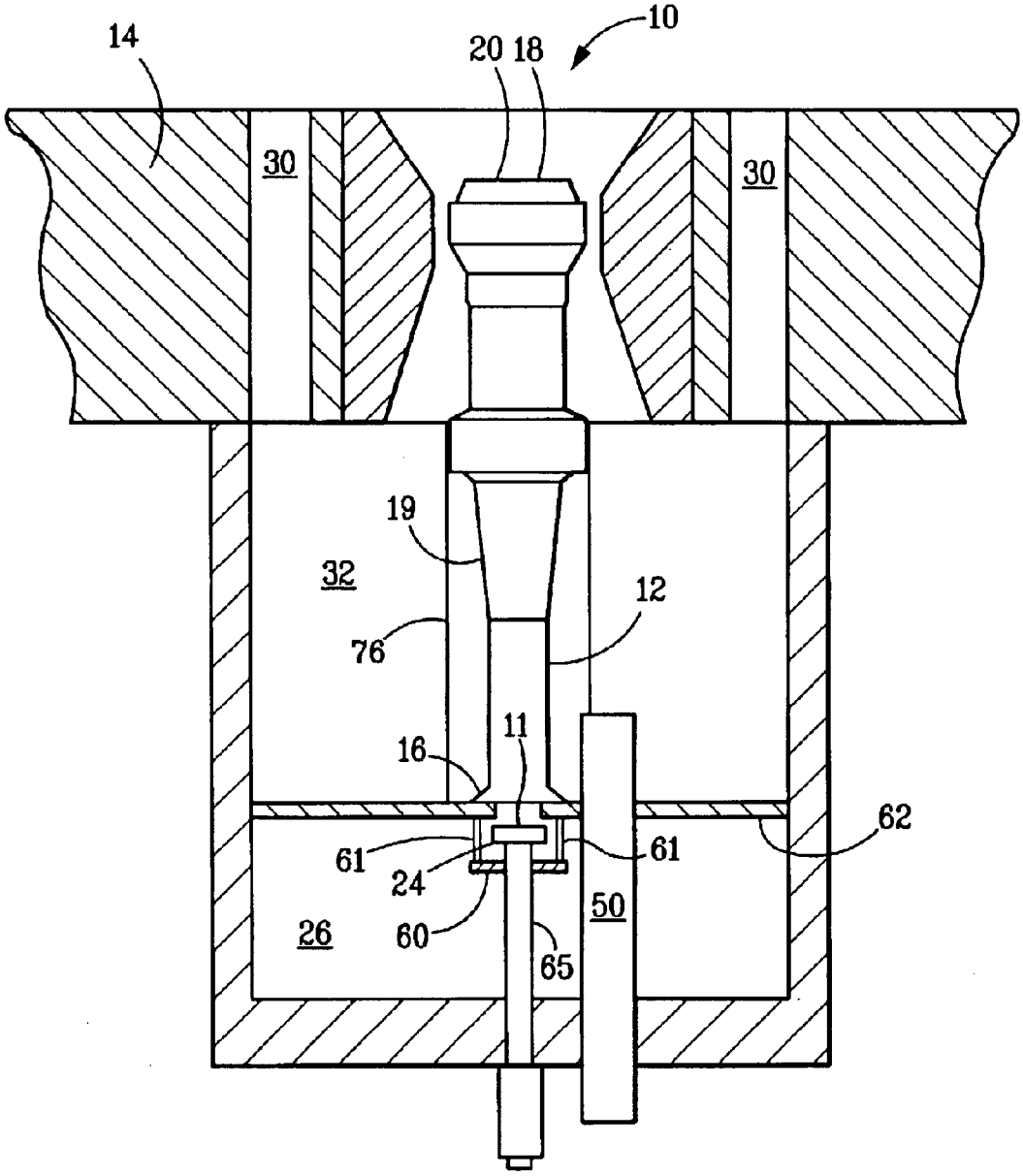
FIG. 2 is an elevation partly in section taken along line 2—2 of FIG. 1.
Figure 3:
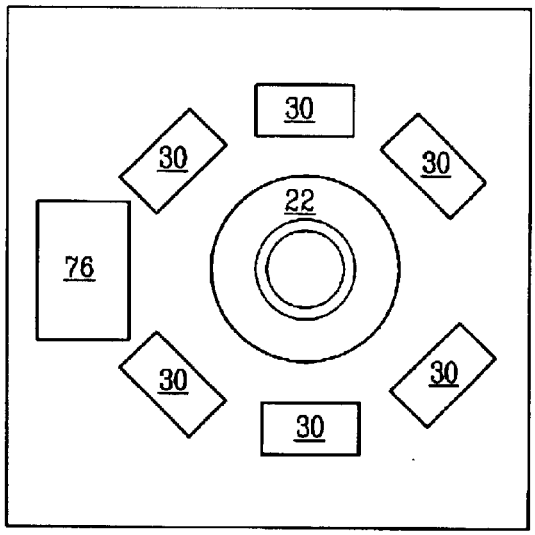
FIG. 3 is a plan view taken along line 3—3 of FIG. 1.

Although the present invention is described in terms of a burner for use in connection with a furnace or an industrial furnace, it will be apparent to one of skill in the art that the teachings of the present invention also have applicability to other process components such as, for example, boilers. Thus, the term furnace herein shall be understood to mean furnaces, boilers and other applicable process components.

Referring to FIGS. 1–4, a burner 10 includes a freestanding burner tube 12 located in a well in a furnace floor 14. The burner tube 12 includes an upstream end 16, a downstream end 18 and a venturi portion 19. A burner tip 20 is located at the downstream end 18 and is surrounded by an annular tile 22. A fuel orifice 11, which may be located within gas spud 24, is located at the top end of a gas fuel riser 65 and is located at the upstream end 16 and introduces fuel gas into the burner tube 12. Fresh or ambient air is introduced into a primary air chamber 26 through an adjustable damper 28 to mix with the fuel gas at the upstream end 16 of the burner tube 12 and pass upwardly through the venturi portion 19. Combustion of the fuel gas and fresh air occurs downstream of the burner tip 20.

A plurality of air ports 30 (FIGS. 2 and 3) originate in a secondary air chamber 32 and pass through the furnace floor 14 into the furnace. Fresh or ambient air enters the secondary air chamber 32 through adjustable dampers 34 and passes through the staged air ports 30 into the furnace to provide secondary or staged combustion, as described in U.S. Pat. No. 4,629,413, which patent is hereby incorporated herein by reference.

Figure 5:
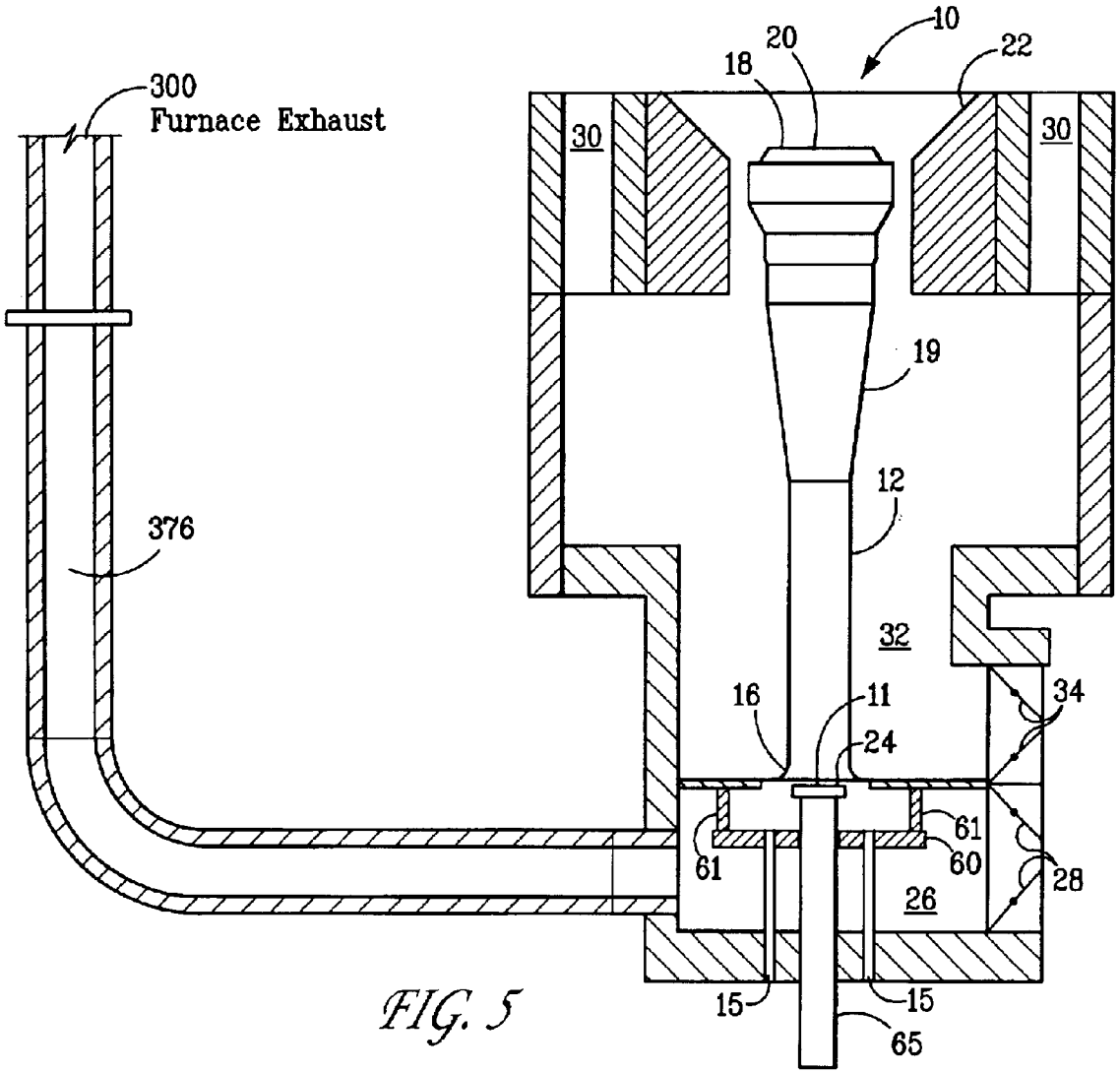
FIG. 5 is an elevation partly in section of an embodiment of the burner of the present invention illustrating an external passageway.

Unmixed low temperature fresh or ambient air, having entered the secondary air chamber 32 through the dampers 34, and having passed through the air ports 30 into the furnace, is also drawn through a passageway 76 into a primary air chamber 26 by the inspirating effect of the fuel gas passing through the venturi portion 19. The passageway 76 is preferably metallic and is employed as a FGR duct. The mixing of the staged or secondary air with the flue gas lowers the temperature of the hot flue gas flowing through the passageway 76 and thereby substantially increases the life of the passageway 76 and allows the use of this type burner to reduce $NO_x$ emissions in high temperature cracking furnaces having flue gas temperature above 1900° F. in the radiant section of the furnace. As an alternative embodiment, shown in FIG. 5, passageway 376 may be external to the furnace and in fluid communication with furnace exhaust 300.

The recirculated flue gas drawn into the primary chamber 26 is mixed with fresh or ambient air drawn into the primary air chamber 26 from an opening 80 through adjustable dampers 28 before the mixture enters the venturi portion 19.

Figure 4:
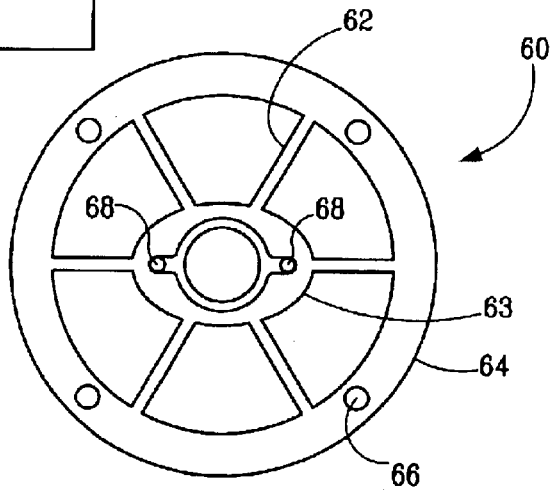
FIG. 4 is a top plan view of a centering plate used in an embodiment of the burner of the present invention.

With reference to FIGS. 1 and 4, support members 61 suspend a perforated centering plate 60 from the roof of the primary air chamber 26. As shown in FIG. 4, a specific embodiment of the perforated centering plate 60 has a plurality of spokes 62 interconnecting a riser centering member 63 and a peripheral ring support member 64. The riser centering member 63 is positioned about the gas riser 65 for maintaining the fuel orifice/gas spud in proper alignment with the inlet to the venturi portion 19. The ring member 64 has a plurality of holes 66 for use in securing the centering plate 60 to the support members 61.

In one embodiment of the present invention, centering plate 60 also contains a pair of holes 68 to permit a corresponding pair of steam injection tubes 15 to pass through centering plate 60 to the extent such steam injection tubes 15 are present.

As noted above, the centering plate 60 is perforated to permit flow therethrough of air from the primary air chamber 26 which avoids flow losses that result from a normally tortuous flow pattern caused by a presently used solid centering plate. These flow losses are avoided because the perforated centering plate design smoothes out the flow vectors entering the venturi portion 19 of the burner tube to enable higher venturi capacity, higher flue gas recirculation rate, lower flame temperature and lower $NO_x$ production.

Although centering plate 60 as shown in FIG. 4 is illustrated as circular and although a circular shape is the preferred embodiment of the present invention, it will be understood by those of skill in the art that the centering plate may be formed into many other shapes, including, for example, oval, square, or triangular without departing from the scope or spirit of the present invention.

Sight and lighting port 50 provides access to the interior of the burner for the lighting element (not shown).

Flue gas containing, for example, from about 6 to about 10% $O_2$ is drawn through passageway 76, by the inspirating effect of fuel gas passing through venturi portion 19 of burner tube 12. In this manner, the primary air and flue gas are mixed in primary air chamber 26, which is prior to the zone of combustion. Therefore, the amount of inert material mixed with the fuel is raised, thereby reducing the flame temperature and, as a result, reducing $NO_x$ emissions. This is in contrast to a liquid fuel burner, such as that of U.S. Pat. No. 2,813,526, in which the combustion air is mixed with the fuel at the zone of combustion, rather than prior to the zone of combustion.

Closing or partially closing damper 28 restricts the amount of fresh air that can be drawn into the primary air chamber 26 and thereby provides the vacuum necessary to draw flue gas from the furnace. A mixture of from about 20% to about 80% flue gas and from about 20% to about 80% ambient air should be drawn through duct 76. It is particularly preferred that a mixture of about 50% flue gas and about 50% ambient air be employed. The desired proportions of flue gas and ambient air may be achieved by proper sizing, placement and/or design of flue gas recirculation passageway 76 and air ports 30. That is, the geometry and location of the air ports may be varied to obtain the desired percentages of flue gas and ambient air.

Figure 6:
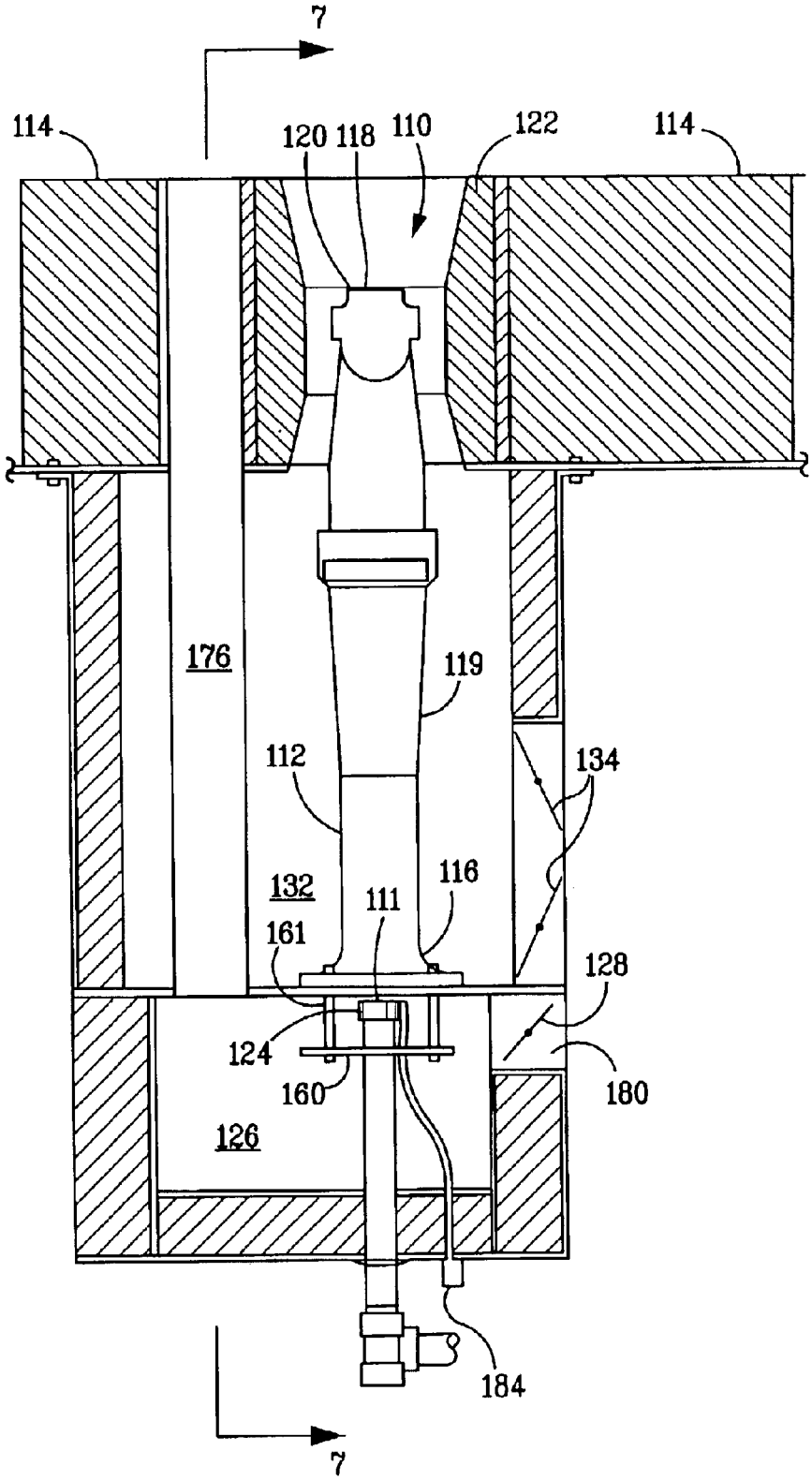
FIG. 6 illustrates an elevation partly in section of an embodiment of a flat-flame burner of the present invention.
Figure 7:
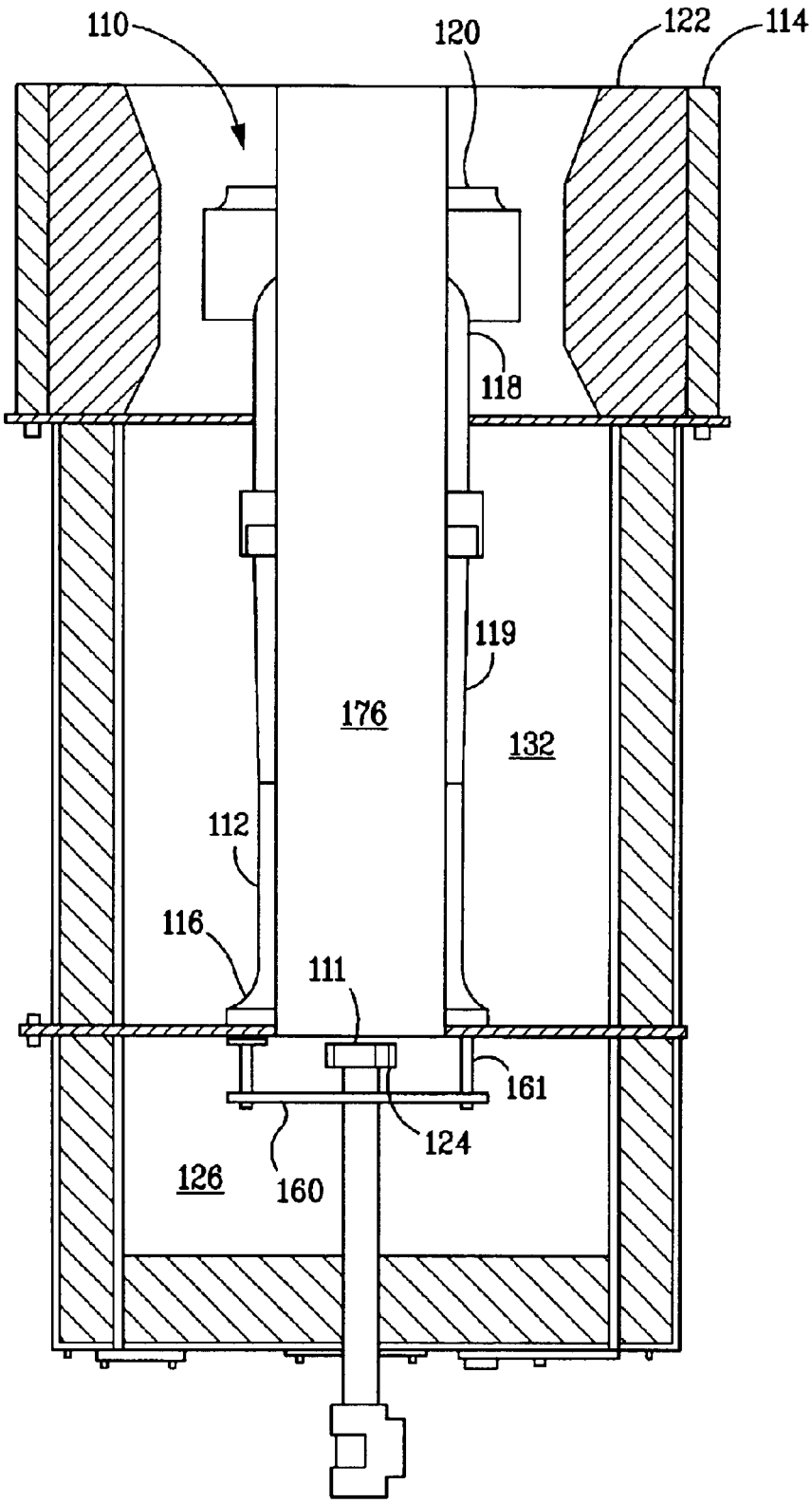
FIG. 7 is an elevation partly in section of the embodiment of a flat-flame burner of FIG. 6 taken along line 7—7 of FIG. 6.

A similar benefit can be achieved in flat-flame burners, as will now be described by reference to FIGS. 6 and 7. A premix burner 110 includes a freestanding burner tube 112 located in a well in a furnace floor 114. Burner tube 112 includes an upstream end 116, a downstream end 118 and a venturi portion 119. Burner tip 120 is located at downstream end 118 and is surrounded by a peripheral tile 122. A fuel orifice 111, which may be located within gas spud 124, is located at upstream end 116 and introduces fuel gas into burner tube 112. Fresh or ambient air may be introduced into primary air chamber 126 to mix with the fuel gas at upstream end 116 of burner tube 112. Combustion of the fuel gas and fresh air occurs downstream of burner tip 120. Fresh secondary air enters secondary chamber 132 through dampers 134.

In order to recirculate flue gas from the furnace to the primary air chamber, a flue gas recirculation passageway 176 is formed in furnace floor 114 and extends to primary air chamber 126, so that flue gas is mixed with fresh air drawn into the primary air chamber from opening 180 through dampers 128. Flue gas containing, for example, 0 to about 15% $O_2$ is drawn through passageway 176 by the inspirating effect of fuel gas passing through venturi portion 119 of burner tube 112. Primary air and flue gas are mixed in primary air chamber 126, which is prior to the zone of combustion.

In operation, the fuel orifice 111, which may be located within gas spud 124, discharges fuel into burner tube 112, where it mixes with primary air, recirculated flue gas or mixtures thereof. The mixture of fuel gas, recirculated flue-gas, and primary air then discharges from burner tip 120. The mixture in the venturi portion 119 of burner tube 112 is maintained below the fuel-rich flammability limit; i.e. there is insufficient air in the venturi to support combustion.

Secondary air is added to provide the remainder of the air required for combustion.

Figure 8:
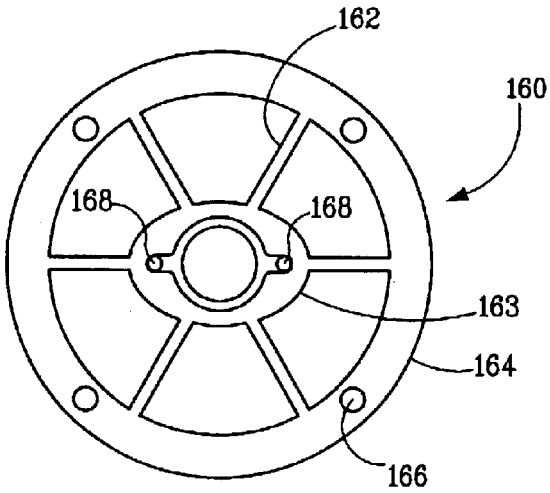
FIG. 8 is a top plan view of a centering plate used in the embodiment of the burner of FIGS. 7 and 8.

Referring now to FIG. 8, as with the previous embodiments, support members 161 suspend a perforated centering plate 160 from the roof of the primary air chamber 126. With reference to the previous embodiment, illustrated in FIG. 4, this embodiment also employ a perforated centering plate 160 which has a plurality of spokes 162 interconnecting a riser centering member 163 and a peripheral ring support member 164. The riser centering member 163 is positioned about the gas riser 165 for maintaining the fuel orifice/gas spud in proper alignment with the inlet to the venturi portion 119. The ring member 164 has a plurality of holes 166 for use in securing the centering plate 160 to the support members 161.

As with the previous embodiment and again referencing FIG. 4, centering plate 160 also contains a pair of holes 168 so as to permit a corresponding pair of steam injection tubes 184 to pass through centering plate 160 when such steam injection tubes 184 are present.

Although the burners of this invention have been described in connection with floor-fired hydrocarbon cracking furnaces, they may also be used in furnaces for carrying out other reactions or functions.

It will also be understood that the teachings described herein also have utility in traditional raw gas burners and raw gas burners having a pre-mix burner configuration wherein flue gas alone is mixed with fuel gas at the entrance to the burner tube. In fact, it has been found that the pre-mix, staged-air burners of the type described in detail herein can be operated with the primary air damper doors closed, with very satisfactory results.

Thus, it can be seen that, by use of this invention, $NO_x$ emissions may be reduced in a burner without the use of fans or otherwise special burners. The centering plate of the burner of the present invention can also easily be retrofitted to existing burners.

In addition to the use of flue gas as a diluent, another technique to achieve lower flame temperature through dilution is through the use of steam injection. Steam can be injected in the primary air or the secondary air chamber. Preferably, steam may be injected upstream of the venturi.

Although the invention has been described with reference to particular means, materials and embodiments, it is to be understood that the invention is not limited to the particulars disclosed and extends to all equivalents within the scope of the claims.

What is claimed is:

1. A burner for the combustion of fuel, said burner being located adjacent a first opening in a furnace, said burner comprising:

(a) a primary air chamber having a roof;

(b) a burner tube including a downstream end and an upstream end, a burner tip adjacent the first opening in the furnace, so that combustion of the fuel gas takes place downstream of said burner tip;

(c) a fuel orifice located adjacent the upstream end of said burner tube, for introducing fuel into said burner tube, said fuel orifice being located on a riser; and (d) a fixed plate for centering said fuel orifice in alignment with said burner tube, said centering plate suspended from said roof of said primary air chamber and positioned substantially parallel thereto, said centering plate perforated to permit flow therethrough from said primary air chamber.

2. The burner according to claim 1 wherein said burner is a pre-mix burner.

3. The burner according to claim 1 wherein said burner is a flat-flame burner.

4. The burner according to claim 1 wherein said burner tip is mounted on the downstream end of said burner tube.

5. The burner according to claim 1 wherein said upstream end of said burner tube is in fluid communication with said primary air chamber and the fuel.

6. The burner according to claim 1 wherein said fuel comprises fuel gas.

7. The burner according to claim 1 wherein said fuel orifice is located within a gas spud.

8. The burner according to claim 1, further comprising:

(a) at least one passageway for supplying flue gas from the furnace into said primary air chamber; and (b) means for drawing flue gas from the furnace through said at least one passageway and said primary air chamber in response to an inspirating effect of uncombusted fuel gas exiting the fuel orifice, said uncombusted fuel gas flowing through said burner tube from its upstream end towards its downstream end, whereby the flue gas is mixed with air at said upstream end of said burner tube prior to the zone of combustion of the fuel gas.

9. The burner according to claim 8 wherein said fuel orifice is located within a gas spud.

10. The burner according to claim 8 wherein each of said at least one passageways is internal to the burner.

11. The burner according to claim 8 wherein each of said at least one passageway is at least partially external to the furnace.

12. The burner according to claim 8 wherein each of said at least one passageways has a first end at a second opening in the furnace and a second end opening into said primary air chamber, said primary air chamber being in fluid communication with the upstream end of said burner tube.

13. The burner according to claim 8, wherein said means for drawing flue gas from said furnace comprises a venturi portion in said burner tube.

14. The burner according to claim 8, wherein said means for drawing flue gas further comprises a first adjustable damper opening in fluid communication with said primary air chamber and a source of air.

15. The burner according to claim 14, wherein said first adjustable damper opening is effective to restrict the amount of air entering into said primary air chamber and thereby providing a vacuum to draw flue gas from the furnace.

16. The burner according to claim 8, further comprising a secondary air chamber, and a second adjustable damper opening into said secondary air chamber to restrict the amount of air entering into said secondary air chamber, said secondary air chamber being in fluid communication with at least one air opening into the furnace.

17. The burner according to claim 16, wherein said secondary air chamber is in fluid communication with a plurality of said air openings.

18. The burner according to claim 17, wherein said centering plate has an outer ring member, an inner centering member and a plurality of radially extending spokes connecting said outer ring member and said inner centering member.

19. The burner according to claim 18, wherein said outer ring member fixedly secures said centering plate within said primary air chamber, and wherein said gas riser extends through said inner centering member and is supported therein.

20. The burner according to claim 19, wherein said outer ring member is connected to a surface of said primary air chamber by a plurality of support members.

21. The burner according to claim 1, wherein said centering plate has an outer ring member, an inner centering member and a plurality of radially extending spokes connecting said outer ring member and said inner centering member.

22. The burner according to claim 21, wherein said outer ring member fixedly secures said centering plate within said primary air chamber, and wherein said gas riser extends through said inner centering member and is supported therein.

23. The burner according to claim 22, wherein said outer ring member is connected to said roof of said primary air chamber by a plurality of support members.

24. The burner according to claim 1, further comprising means for injecting steam into said primary air chamber.

25. The burner according to claim 24, wherein said centering plate includes at least one hole for positioning at least one steam injection tube therethrough.

26. A method for reducing $NO_x$ emissions in a burner for the combustion of fuel, the burner being located adjacent a first opening in a furnace and including a primary air chamber having a roof, a burner tube including a downstream end and an upstream end for receiving air from the primary air chamber and fuel, a burner tip adjacent the first opening in the furnace, so that combustion of the fuel takes place downstream of the burner tip and a fuel orifice located adjacent the upstream end of said burner tube, for introducing fuel into said burner tube, the fuel orifice being mounted on a riser; the method comprising installing a fixed plate for centering the fuel orifice in alignment with said burner tube, the centering plate suspended from the roof of the primary air chamber and positioned substantially parallel thereto, the centering plate being perforated to permit flow therethrough from the primary air chamber.

27. The method according to claim 26, wherein the burner is a pre-mix burner.

28. The method according to claim 26, wherein the burner is a flat-flame burner.

29. The method according to claim 26, wherein the burner tip is mounted on the downstream end of said burner tube.

30. The method according to claim 26, wherein the upstream end of the burner tube is in fluid communication with the primary air chamber.

31. The method according to claim 26, wherein the fuel comprises fuel gas.

32. The method according to claim 26, wherein the fuel orifice comprises a gas spud.

33. The method according to claim 26, wherein the centering plate has an outer ring member, an inner centering member and a plurality of radially extending spokes connecting the outer ring member and said inner centering member.

34. The method according to claim 33, wherein the outer ring member fixedly secures the centering plate within the primary air chamber, and wherein the gas riser extends through the inner centering member and is supported therein.

35. The method according to claim 34, wherein the outer ring member is connected to the roof of the primary air chamber by a plurality of support members.

36. The method according to claim 26, wherein the furnace is a steam cracking furnace.

37. A method for reducing $NO_x$ emissions in a burner for the combustion of fuel, the burner being located adjacent a first opening in a furnace and including a primary air chamber having a roof, a burner tube including a downstream end and an upstream end for receiving air from said primary air chamber and fuel, a burner tip adjacent the first opening in the furnace, so that combustion of the fuel takes place downstream of the burner tip and a fuel orifice located adjacent the upstream end of said burner tube, for introducing fuel into said burner tube, the fuel orifice being mounted on a riser; the method comprising providing a fixed plate for centering the fuel orifice in alignment with said burner tube, the centering plate suspended from the roof of the primary air chamber and positioned substantially parallel thereto, the centering plate being perforated to permit flow therethrough from the primary air chamber.

* * * * *